US009816741B2

(12) United States Patent
Lee et al.

(10) Patent No.: US 9,816,741 B2
(45) Date of Patent: Nov. 14, 2017

(54) METHOD FOR CONTROLLING SUPPLY OF REFRIGERANT TO EVAPORATORS IN A REFRIGERATOR BY PREVENTING UNEQUAL DISTRIBUTION USING A FLOW VALVE BASED ON A TEMPERATURE OF EACH EVAPORATOR

(71) Applicant: LG Electronics Inc., Seoul (KR)

(72) Inventors: Sangbong Lee, Seoul (KR); Jangseok Lee, Seoul (KR); Hyoungkeun Lim, Seoul (KR); Myungjin Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 315 days.

(21) Appl. No.: 14/531,065

(22) Filed: Nov. 3, 2014

(65) Prior Publication Data

US 2015/0121917 A1 May 7, 2015

(30) Foreign Application Priority Data

Nov. 4, 2013 (KR) ..... 10-2013-0133030

(51) Int. Cl.
*F25D 17/06* (2006.01)
*F25B 49/02* (2006.01)
(Continued)

(52) U.S. Cl.
CPC ..... *F25B 49/02* (2013.01); *F25B 5/02* (2013.01); *F25B 49/005* (2013.01); *F25D 29/00* (2013.01);
(Continued)

(58) Field of Classification Search
CPC ..... F25B 2600/2507; F25B 2700/2117; F25B 2600/2511; F25B 2313/0233; F25B 5/02
(Continued)

(56) References Cited

U.S. PATENT DOCUMENTS 5,031,413 A 7/1991 Tsuihiji et al.
6,598,410 B2 * 7/2003 Temmyo ..... F25B 5/02 62/179
(Continued)

FOREIGN PATENT DOCUMENTS

CN 1979064 6/2007
EP 2 413 068 A2 2/2012
(Continued)

OTHER PUBLICATIONS

Chinese Office Action dated Jul. 4, 2016.
(Continued)

*Primary Examiner* — Allen Flanigan
*Assistant Examiner* — Filip Zec
(74) *Attorney, Agent, or Firm* — KED & Associates, LLP

(57) ABSTRACT

A refrigerator and a method for controlling a refrigerator are provided. The method may include driving a refrigerating cycle including a first evaporator and a second evaporator by activating at least one compressor, supplying refrigerant to the first and second evaporators by controlling a flow adjuster, recognizing whether the refrigerant is unequally introduced into the first or second evaporator, by sensing a temperature of the first or second evaporator through at least one temperature sensor, reducing supply of the refrigerant to the first or second evaporator into which the refrigerant is unequally introduced, by adjusting the flow adjuster, storing information about an operation time of the flow adjuster, recognizing whether the at least one temperature sensor has malfunctioned, and determining an operation time of the flow adjuster according to whether the at least one temperature sensor has malfunctioned.

10 Claims, 7 Drawing Sheets

(51) Int. Cl.
*F25B 5/02* (2006.01)
*F25B 49/00* (2006.01)
*F25D 29/00* (2006.01)

(52) U.S. Cl.
CPC ..... *F25B 2600/0251* (2013.01); *F25B 2600/2507* (2013.01); *F25B 2600/2515* (2013.01); *F25B 2700/2117* (2013.01)

(58) Field of Classification Search
USPC ..... 62/190
See application file for complete search history.

(56) References Cited

U.S. PATENT DOCUMENTS 7,628,025 B2 * 12/2009 Kang ..... F25B 5/02 62/199
7,765,815 B2 * 8/2010 Yoon ..... F25B 5/00 62/150
8,739,567 B2 * 6/2014 Junge ..... F25B 5/02 62/335
2007/0068180 A1 3/2007 Yoon et al.
2012/0047924 A1 * 3/2012 Li ..... F25B 5/02 62/113
2013/0186129 A1 7/2013 Bae et al.

FOREIGN PATENT DOCUMENTS

JP 2001-263902 9/2001
JP 2009-250598 A 10/2009

OTHER PUBLICATIONS

European Search Report dated Apr. 15, 2016.
European Search Report dated Apr. 24, 2015 issued in Application No. 14191498.6.

* cited by examiner

METHOD FOR CONTROLLING SUPPLY OF REFRIGERANT TO EVAPORATORS IN A REFRIGERATOR BY PREVENTING UNEQUAL DISTRIBUTION USING A FLOW VALVE BASED ON A TEMPERATURE OF EACH EVAPORATOR

CROSS-REFERENCE TO RELATED APPLICATION(S)

The present application claims priority under 35 U.S.C. 119 and 35 U.S.C. 365 to Korean Patent Application No. 10-2013-0133030, filed In Korea on Nov. 4, 2013, which is hereby incorporated by reference in its entirety.

BACKGROUND

1. Field

A refrigerator and a method for controlling a refrigerator are disclosed herein.

2. Background

Refrigerators include a plurality of storages to store food or other items in a frozen state or a refrigerated state. The plurality of storages have an open side to allow access to the food stored in the storages. The storages may include a freezer compartment to store food in the frozen state, and a refrigerator compartment to store food in the refrigerated state.

A refrigerating system through which refrigerant circulates may be driven in such a refrigerator. The refrigerating system may include a compressor, a condenser, an expansion device, and an evaporator. The evaporator may include a first evaporator disposed at a side of a refrigerator compartment, and a second evaporator disposed at a side of a freezer compartment.

Cold air stored in the refrigerator compartment may be cooled by the first evaporator, and then, may be supplied again to the refrigerator compartment. Cold air stored in the freezer compartment may be cooled by the second evaporator, and then, may be supplied again to the freezer compartment. The refrigerant may be selectively supplied to the first or second evaporator and be evaporated.

As such, typical refrigerators are configured such that a plurality of storages are independently cooled by separate evaporators, and refrigerant is supplied to any one of the evaporators to cool one of the storages and stop cooling of the other storages. Thus, simultaneous cooling of the storages is not accomplished, and one of the storages and the others are selectively or alternately cooled.

In this case, the storage which is cooled is maintained within an appropriate range of temperature, but temperatures of the storages which are not cooled increase outside of a normal or appropriate range. In addition, when cooling of one of the storages is needed, it may be sensed that the temperatures of the other storages are not within the normal or appropriate range. In this case, the other storages cannot be instantly cooled.

As a result, a structure for independently cooling storages cannot supply cold air to a suitable place at a suitable time, thus decreasing operation efficiency of a refrigerator.

BRIEF DESCRIPTION OF THE DRAWINGS

Embodiments will be described in detail with reference to the following drawings in which like reference numerals refer to like elements, and wherein.

DETAILED DESCRIPTION

Figure 1:
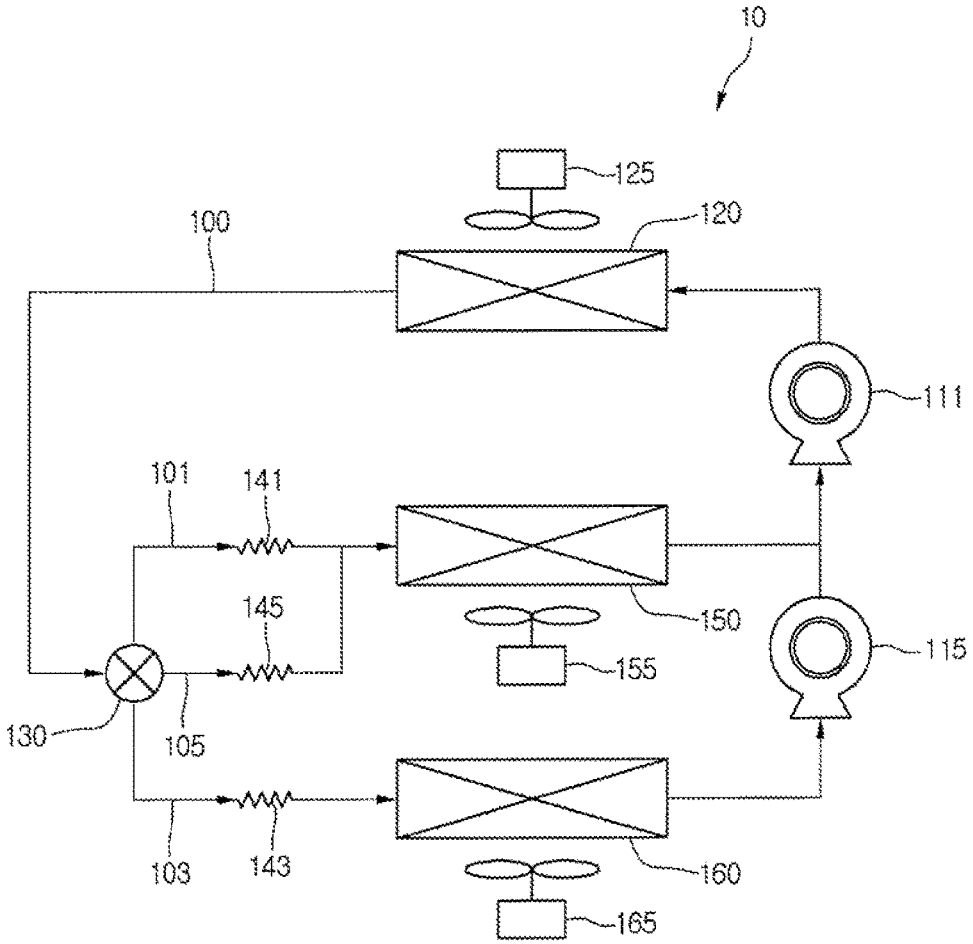
FIG. 1 is a schematic diagram of a refrigerating cycle of a refrigerator according to an embodiment.

Reference will now be made in detail to embodiments examples of which are illustrated in the accompanying drawings. Where possible, like reference numerals have been used to indicate like elements, and repetitive disclosure has been omitted.

FIG. 1 is a schematic diagram of a refrigerating cycle of a refrigerator according to an embodiment. Referring to FIG. 1, a refrigerator 10 according to this embodiment may include a plurality of devices to drive a refrigerating cycle.

In particular, the refrigerator 10 may include a plurality of compressors 111 and 115 to compress refrigerant, a condenser 120 to condense the refrigerant compressed at the compressors 111 and 115, a plurality of expansion devices 141, 143, and 145 to depressurize the refrigerant condensed at the condenser 120, and a plurality of evaporators 150 and 160 to evaporate the refrigerant depressurized at the plurality of expansion devices 141, 143, and 145. Further, the refrigerator 10 may include a refrigerant pipe 100 that connects the plurality of compressors 111 and 115, the condenser 120, the plurality of expansion devices 141, 143, and 145, and the plurality of evaporators 150 and 160 to one another to guide flow of the refrigerant.

The plurality of compressors 111 and 115 may include a second compressor 115 disposed at a low pressure side, and a first compressor 111 to further compress refrigerant compressed at the second compressor 115. The first compressor 111 may be connected in series to the second compressor 115. That is, a portion of the refrigerant pipe 100 disposed at an outlet side of the second compressor 115 may be connected to an inlet side of the first compressor 111.

The plurality of evaporators 150 and 160 may include a first evaporator 150 to generate cold air to be supplied to any one of a refrigerator compartment and a freezer compartment, and a second evaporator 160 to generate cold air to be supplied to the other. For example, the first evaporator 150, which may be "an evaporator for the refrigerator compartment", may generate cold air to be supplied to the refrigerator compartment and be disposed at a side of the refrigerator compartment. The second evaporator 160, which may be "an evaporator for the freezer compartment", may generate cold air to be supplied to the freezer compartment and be disposed at a side of the freezer compartment.

A temperature of the cold air supplied to the freezer compartment may be lower than a temperature of the cold air supplied to the refrigerator compartment. Thus, a refrigerant evaporation pressure of the second evaporator 160 may be lower than a refrigerant evaporation temperature of the first evaporator 150.

A portion of the refrigerant pipe 100 disposed at an outlet side of the second evaporator 160 may extend to an inlet side of the second compressor 115. Thus, the refrigerant having passed through the second evaporator 160 may be introduced into the second compressor 115.

A portion of the refrigerant pipe 100 disposed at an outlet side of the first evaporator 150 may be connected to the portion of the refrigerant pipe 100 disposed at the outlet side of the second compressor 115. Thus, the refrigerant having passed through the first evaporator 150 may join the refrigerant compressed at the second compressor 115 and be introduced into the first compressor 111.

The plurality of expansion devices 141, 143, and 145 may include first and third expansion devices 141 and 145 to expand the refrigerant to be introduced into the first evaporator 150, and a second expansion device 143 to expand the refrigerant to be introduced into the second evaporator 160. The first to third expansion devices 141, 143, and 145 may include capillary tubes.

The second evaporator 160 may be used as an evaporator for the freezer compartment, and the first evaporator 150 may be used as an evaporator for the refrigerator compartment. In this case, a diameter of a capillary tube of the second expansion device 143 may be smaller than diameters of capillary tubes of the first and third expansion devices 141 and 145, such that the refrigerant evaporation pressure of the second evaporator 160 is lower than the refrigerant evaporation pressure of the first evaporator 150.

Refrigerant passages 101 and 105 may be disposed at an inlet side of the first evaporator 150 to guide the refrigerant to be introduced into the first evaporator 150. The refrigerant passages 101 and 105 may include a first refrigerant passage 101 on which the first expansion device 141 is installed, and a third refrigerant passage 105 on which the third expansion device 145 may be installed. The first and third refrigerant passages 101 and 105 may guide the refrigerant to be introduced into the first evaporator 150, and thus, may be referred to as "first evaporation passages". The refrigerant flowing through the first refrigerant passage 101 and the refrigerant flowing through the third refrigerant passage 105 may join each other, and then, may be introduced into the first evaporator 150.

A refrigerant passage 103 may be disposed at an inlet side of the second evaporator 160 to guide the refrigerant to be introduced into the second evaporator 160. The refrigerant passage 103 may include a second refrigerant passage 103 on which the second expansion device 143 may be installed. The second refrigerant passage 103 may guide the refrigerant to be introduced into the second evaporator 160, and thus, may be referred to as "a second evaporation passage". The first to third refrigerant passages 101, 103, and 105 may be understood as "branch passages" diverging from the refrigerant pipe 100.

The refrigerator 10 may include a flow adjuster 130 that divides the refrigerant to be introduced into the first to third refrigerant passages 101, 103, and 105. The flow adjuster 130 may be understood as a device to adjust flows of the refrigerant such that at least one of the first and second evaporators 150 and 160 is operated, that is, such that the refrigerant may be introduced into any one of the first and second evaporators 150 and 160 or both the first and second evaporators 150 and 160. The flow adjuster 130 may include a four-way valve, which may include an inflow, through which the refrigerant may be introduced, and three outflows, through which the refrigerant may be discharged.

The first to third refrigerant passages 101, 103, and 105 may be connected to the three outflows of the flow adjuster 130, respectively. Thus, the refrigerant passing through the flow adjuster 130 may be divided and discharged to the first to third refrigerant passages 101, 103, and 105. The outflows connected to the first to third refrigerant passages 101, 103, and 105 may be referred to as "a first outflow", "a second outflow", and "a third outflow", respectively.

At least one of the first to third outflows may be open. For example, when the first to third outflows re open, the refrigerant may flow through the first to third refrigerant passages 101, 103, and 105. When the first and second outflows are open, and the third outflow part is closed, the refrigerant may flow through the first and second refrigerant passages 101 and 103.

The first outflow may be open, and the second and third outflows may be closed, so that the refrigerant may flow through only the first refrigerant passage 101. The second outflow may be open, and the first and third outflows may be closed, so that the refrigerant may flow through only the second refrigerant passage 103.

According to such a control of the flow adjuster 130, a flow path of the refrigerant may be changed. The flow adjuster 130 may be controlled based on whether the refrigerant is insufficient or excessive in the first evaporator 150 or the second evaporator 160.

For example, when the first and second evaporators 150 and 160 are simultaneously operated, and the refrigerant is relatively insufficient in the first evaporator 150, the flow adjuster 130 may be controlled such that the refrigerant flows through the first to third refrigerant passages 101, 103, and 105. In contrast, when the refrigerant is relatively insufficient in the second evaporator 160, the third refrigerant passage 105 are closed, and the flow adjuster 130 may be controlled such that the refrigerant flows through the first and second refrigerant passages 101 and 103. That is, a plurality of flow paths for the refrigerant to be introduced into the first evaporator 150 may be provided as the first and third refrigerant passages 101 and 105, and flows of the refrigerant through the first and third refrigerant passages 101 and 105 may be selectively controlled, thereby adjusting an amount of the refrigerant to be introduced into the first evaporator 150 or the second evaporator 160.

As the inlet side of the first evaporator 150 is superior to the inlet side of the second evaporator 160 in terms of number of refrigerant paths, when the first to third refrigerant passages 101, 103, and 105 are open, a larger amount of refrigerant flows to the first evaporator 150 than to the second evaporator 160. That is, a heat exchange ability of the first evaporator 150 may be greater than a heat exchange ability of the second evaporator 160. Thus, when the first evaporator 150 is an evaporator for the refrigerator compartment, and the second evaporator 160 is an evaporator for the freezer compartment, a cooling load or capacity of the refrigerator compartment may be greater than a cooling load or capacity of the freezer compartment.

The refrigerator 10 may include blower fans 125, 155, and 165 disposed at a side of each heat exchanger, respectively, to blow air. The blower fans 125, 155, and 165 may include a condensing fan 125 disposed at a side of the condenser 120, a first evaporation fan 155 disposed at a side of the first evaporator 150, and a second evaporation fan 165 disposed at a side of the second evaporator 160.

The heat exchange abilities of the first and second evaporators 150 and 160 may be changed according to rotation speeds of the first and second evaporation fans 155 and 165. For example, when a large amount of cold air generated according to an operation of the first evaporator 150 is needed, the rotation speed of the first evaporation fan 155 may be increased. In addition, when the cold air generated according to the operation of the first evaporator 150 is sufficient, the rotation speed of the first evaporation fan 155 may be decreased.

Figure 2:
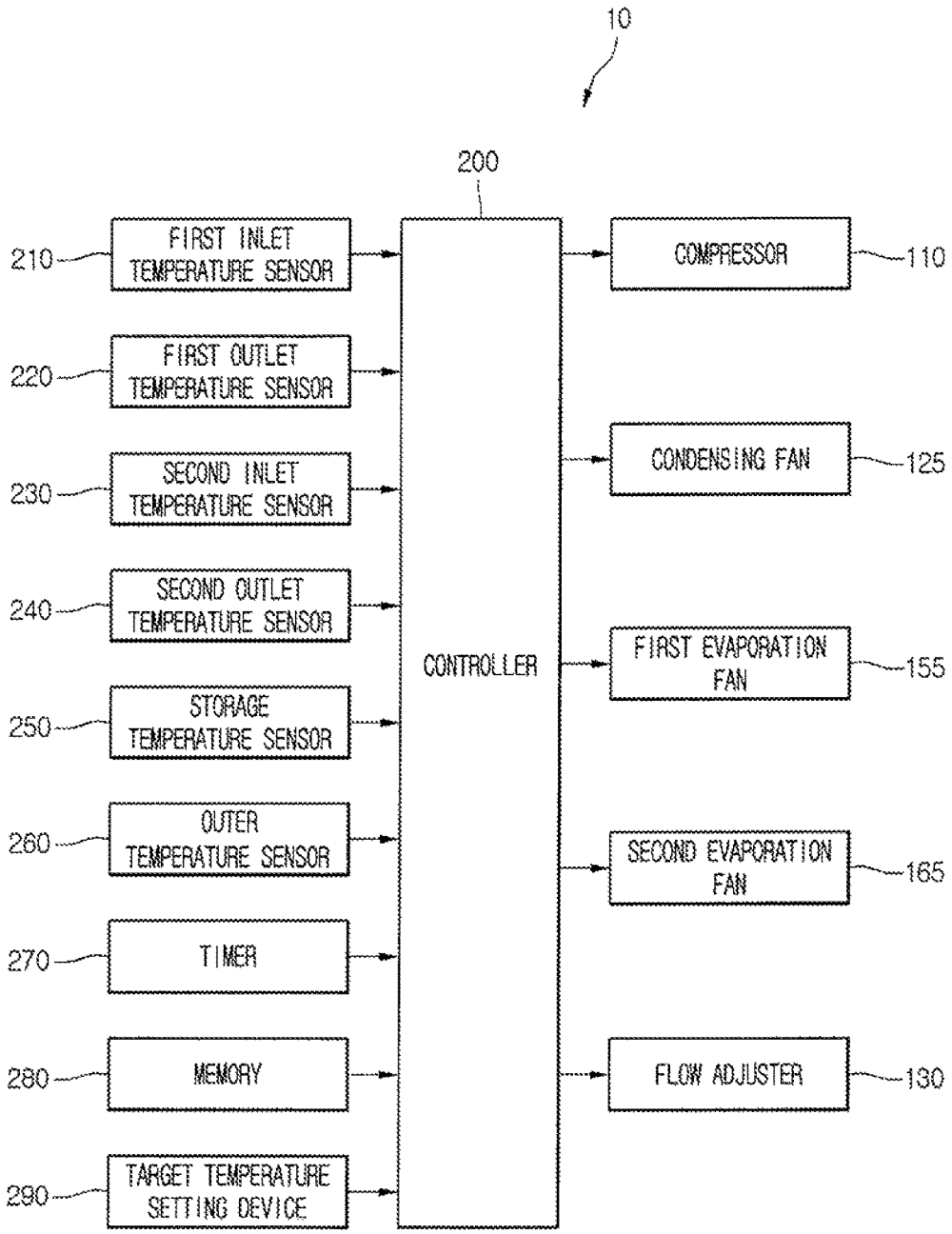
FIG. 2 is a block diagram of the refrigerator of FIG. 1.

FIG. 2 is a block diagram of the refrigerator of FIG. 1. Referring to FIG. 2, the refrigerator 10 may include a plurality of temperature sensors 210, 220, 230, and 240 to sense inlet temperatures and outlet temperatures of the first evaporator 150 and the second evaporator 160. The plurality of temperature sensors 210, 220, 230, and 240 may include a first inlet temperature sensor 210 to sense an inlet temperature of the first evaporator 150, and a first outlet temperature sensor 220 to sense an outlet temperature of the first evaporator 150. Further, the plurality of temperature sensors 210, 220, 230, and 240 may include a second inlet temperature sensor 230 to sense an inlet temperature of the second evaporator 160, and a second outlet temperature sensor 240 to sense an outlet temperature of the second evaporator 160.

The refrigerator 10 may also include a storage temperature sensor 250 to sense an inner temperature of a storage of the refrigerator 10, and an outer temperature sensor 260 to sense an outer temperature of the refrigerator 10. The storage temperature sensor 250 may include a refrigerator compartment temperature sensor disposed in the refrigerator compartment to sense an inner temperature of the refrigerator compartment, and a freezer compartment temperature sensor disposed in the freezer compartment to sense a temperature of the freezer compartment.

The refrigerator 10 may include a controller 200 that controls an operation of the flow adjuster 130, based on temperature values sensed at the temperature sensors 210, 220, 230, 240, 250, and 260. The controller 200 may control operations of a compressor 110, the condensing fan 125, and the first and second evaporation fans 155 and 165 for a simultaneous cooling operation on the refrigerator compartment and the freezer compartment. The compressor 110 may include the first compressor 111 and the second compressor 115.

The refrigerator 10 may include a timer 270 that detects operation elapsed time values of the flow adjuster 130 during the simultaneous cooling operation on the refrigerator compartment and the freezer compartment. For example, the timer 270 may detect elapsed times when the first to third refrigerant passages 101, 103, and 105 are open, or elapsed times when the first and second refrigerant passages 101 and 103 are open and the third refrigerant passage 105 is closed.

Further, the refrigerator 10 may include a memory 280 that stores time values of simultaneous operations of the refrigerator compartment and the freezer compartment. The time values may be mapped onto information about the outer temperature of the refrigerator 10 and information about a temperature condition of the storage of the refrigerator 10, that is, information about an inner temperature of the refrigerator compartment or the freezer compartment.

In particular, an outer temperature value may be sensed by the outer temperature sensor 260, and a state condition or state information of a storage may be determined based on a temperature value sensed at the refrigerator compartment temperature sensor or the freezer compartment temperature sensor, or based on information about whether the compressor 110 is activated. For example, the state condition of a storage may include a "cooling activation" state, a "freezer compartment load reaction" state, a "refrigerator compartment load reaction" state, and a "simultaneous storage cooling (simultaneous cooling of the refrigerator compartment and the freezer compartment)" state.

The "cooling activation" state may be understood as a state in which re driving of the compressor 110 starts after the compressor 110 is turned off. That is, the "cooling activation" state may range from a state, in which the compressor 110 is turned off and a high pressure and a lower pressure of the refrigerant are out of a set or predetermined range, to a state in which the refrigerant has a pressure within the set range after the compressor 110 is activated before step S12 of FIG. 3. For example, the cooling activation state may be maintained for about 2 to 3 minutes after an operation of the compressor 110 starts.

The "freezer compartment load reaction" state may be understood as a state in which the temperature of the freezer compartment unexpectedly increases, for example, a state in which a door of the freezer compartment is open for a long time and the temperature of the freezer compartment unexpectedly increases to a temperature equal to or higher than a set or predetermined temperature. The "refrigerator compartment load reaction" state may be understood as a state in which a temperature of the refrigerator compartment unexpectedly increases, for example, a state in which a door of the refrigerator compartment is open for a long time and the temperature of the refrigerator compartment unexpectedly increases to a temperature equal to or higher than a set or predetermined temperature. The "simultaneous storage cooling (simultaneous cooling of the refrigerator compartment and the freezer compartment)" state may be understood as a state in which simultaneous cooling of the refrigerator compartment and the freezer compartment is needed, for example, a state in which the inner temperatures of the refrigerator compartment and the freezer compartment fail to reach target temperatures.

In general, when an operation of a refrigerator starts to perform a cooling activation process on a compressor and stabilize a refrigerating cycle, simultaneous cooling of storages may be selectively repeated according to temperatures of the storages. In addition, a refrigerator compartment load reaction operation or a freezer compartment load reaction operation may be performed in a special case, in which a user leaves opens a door of a refrigerator compartment or a freezer compartment for a long time.

According to this embodiment, the memory 280 may store mapped information as shown in Table 1.

TABLE 1

| OUTER TEMPERATURE | | OUTER TEMPERATURE ≤16° C. | | 16° C. < OUTER TEMPERATURE ≤28° C. | | OUTER TEMPERATURE >28° C. | |
|---|---|---|---|---|---|---|---|
| CONDITION | | CASE 1 | CASE 2 | | | | |
| STORAGE STATE CONDITION | COOLING ACTIVATION | 90 seconds | 90 seconds | 100 seconds | 120 seconds | 110 seconds | 150 seconds |
| | FREEZER COMPARTMENT LOAD REACTION | 90 seconds | 120 seconds | 120 seconds | 150 seconds | 150 seconds | 180 seconds |

TABLE 1-continued

| OUTER TEMPERATURE | OUTER TEMPERATURE ≤16° C. | | 16° C. < OUTER TEMPERATURE | | OUTER TEMPERATURE | |
|---|---|---|---|---|---|---|
| CONDITION | CASE 1 | CASE 2 | ≤28° C. | | >28° C. | |
| REFRIGERATOR COMPARTMENT LOAD REACTION | 120 seconds | 90 seconds | 150 seconds | 120 seconds | 180 seconds | 150 seconds |
| SIMULTANEOUS STORAGE COOLING | 60 seconds | 100 seconds | 90 seconds | 150 seconds | 120 seconds | 180 seconds |

Referring to Table 1, "case 1" is a first control state of the flow adjuster 130, in which the flow adjuster 130 is adjusted to open the first to third refrigerant passages 101, 103, and 105. That is, "case 1" is a control state to address an unequal introduction of refrigerant to the second evaporator 160 and may be understood as "a first adjustment state" of the flow adjuster 130.

"Case 2" is a second control state of the flow adjuster 130, in which the flow adjuster 130 is adjusted to open the first and second refrigerant passages 101 and 103, and close the third refrigerant passage 105. That is, "case 2" is a control state to address an unequal introduction of refrigerant to the first evaporator 150 and may be understood as "a second adjustment state" of the flow adjuster 130. For example, when a storage state condition is the "cooling activation" state, and the outer temperature of the refrigerator 10 is equal to or lower than about 16° C., the flow adjuster 130 may be controlled for about 90 seconds according to case 1, and then, may be controlled for about 90 seconds according to case 2. When the storage state condition is the "cooling activation" state, and the outer temperature of the refrigerator 10 is higher than about 16° C. and equal to or lower than about 28° C., the flow adjuster 130 may be controlled for about 100 seconds according to case 1, and then, may be controlled for about 120 seconds according to case 2.

As another example, when the storage state condition is the "freezer compartment load reaction" state, and the outer temperature of the refrigerator 10 is equal to or lower than about 16° C., the flow adjuster 130 may be controlled for about 90 seconds according to case 1, and then, may be controlled for about 120 seconds according to case 2. When the storage state condition is the "freezer compartment load reaction" state, and the outer temperature of the refrigerator 10 is higher than about 16° C. and equal to or lower than about 28° C., the flow adjuster 130 may be controlled for about 120 seconds according to case 1, and then, may be controlled for about 150 seconds according to case 2.

As another example, when the storage state condition is the "refrigerator compartment load reaction" state, and the outer temperature of the refrigerator 10 is equal to or lower than about 16° C., the flow adjuster 130 may be controlled for about 120 seconds according to case 1, and then, may be controlled for 90 seconds according to case 2. When the storage state condition is the "refrigerator compartment load reaction" state, and the outer temperature of the refrigerator 10 is higher than about 16° C. and equal to or lower than about 28° C., the flow adjuster 130 may be controlled for about 150 seconds according to case 1, and then, may be controlled for about 120 seconds according to case 2.

As another example, when the storage state condition is the "simultaneous storage cooling" state, and the outer temperature of the refrigerator 10 is equal to or lower than about 16° C., the flow adjuster 130 may be controlled for about 60 seconds according to case 1, and then, may be controlled for about 100 seconds according to case 2. When the storage state condition is the "simultaneous storage cooling" state, and the outer temperature of the refrigerator 10 is higher than about 16° C. and equal to or lower than about 28° C. the flow adjuster 130 may be controlled for about 90 seconds according to case 1, and then, may be controlled for about 150 seconds according to case 2.

Information about time values as shown in Table 1, based on which controls are performed according to a series of cases 1 and 2 under outer temperature conditions and storage state conditions, may be obtained through repeated experiment.

The memory 280 may further store mapped information as shown in Table 2. In particular, Table 2 may store information about variations of control times in cases 1 and 2 when a cooling operation starts according to cases 1 and 2 under any one of the storage state conditions as shown in Table 1, and the refrigerant is unequally introduced to each of the first and second evaporators 150 and 160. Whether the refrigerant is unequally introduced to the first or second evaporator 150 or 160 may be determined based on inlet and outlet temperature information of the first or second evaporator 150 or 160 (refer to FIG. 4).

TABLE 2

| EQUAL OR UNEQUAL INTRODUCTION OF REFRIGERANT | CASE 1 (SECOND) | CASE 2 (SECOND) |
|---|---|---|
| START OF SIMULTANEOUS COOLING OPERATION (REFERENCE VALUE) | t1 | t2 |
| UNEQUAL INTRODUCTION OF REFRIGERANT TO FIRST EVAPORATOR | t1 | t2 + α |
| UNEQUAL INTRODUCTION OF REFRIGERANT TO SECOND EVAPORATOR | t1 | t2 − α |

For example, when any one of the storage state conditions as shown in Table 1 and outer temperature information are recognized, a cooling operation starts according to cases 1 and 2 based on any one of pieces of the mapped information as shown in Table 2. In particular, the controller 200 may control the flow adjuster 130 to be maintained in the first control state for t1 seconds, and then, may be maintained in the second control state for t2 seconds.

t1 and t2 correspond to values as shown in Table 2 according to cases 1 and 2. For example, when the outer temperature is about 25° C., and the storage state condition is the "cooling activation" state, t1 and t2 may be about 100 seconds and about 120 seconds, respectively. As another example, when the outer temperature is about 25° C., and the storage state condition is the "simultaneous storage cooling" state, t1 and t2 may be about 90 seconds and about 150 seconds, respectively.

The first and second control states of the flow adjuster 130 may be alternately performed until the simultaneous cooling operation is unnecessary.

When the temperature of the refrigerator compartment or the freezer compartment reaches a target temperature while the first and second control states of the flow adjuster 130 are alternately performed, introduction of the refrigerant to at least one of the first and second evaporators 150 and 160 may be stopped (a single operation of an evaporator). When the temperatures of the refrigerator compartment and the freezer compartment reach target temperatures, the compressor 110 may be turned off.

When the single operation of an evaporator or an off state of the compressor 110 is maintained for a predetermined period of time, the simultaneous cooling operation on the refrigerator compartment and the freezer compartment may be needed. In this case, the controller 200 may recognize whether the refrigerant is unequally introduced to an evaporator, based on temperature values of the temperature sensors 210, 220, 230, and 240.

When the controller 200 recognizes whether the refrigerant is unequally introduced to the first evaporator 150, the controller 200 may use variations of time values according to cases 1 and 2. That is, when the refrigerant is unequally introduced to the first evaporator 150, a time of introducing the refrigerant into the second evaporator 160 should be relatively increased. Thus, a control time in case 2 may be increased (t2+$\alpha$ seconds).

In contrast, when the refrigerant is unequally introduced to the second evaporator 160, the controller 200 may decrease the control time in case 2 (t2−$\alpha$ seconds) to relatively increase a time of introducing the refrigerant into the first evaporator 150. That is, it is recognized that the refrigerant is unequally introduced to an evaporator, a control time in case 2 may be adjusted to prevent the refrigerant from being unequally introduced to the evaporator. It may be recognized that a cooling load of a storage in which the second evaporator 160 is disposed is smaller than a cooling load of a storage in which the first evaporator 150 is disposed.

As a result, a control time in case 1 to increase an amount of the refrigerant introduced to the storage having the large cooling load is fixed, and a control time in case 2 to increase an amount of the refrigerant introduced to the storage having the small cooling load is changed. Accordingly, cooling efficiency of the storage having the large cooling load may be stably maintained.

Information about the time values of sequentially performing cases 1 and 2 in the simultaneous cooling operation, and information about the variations of the time values of sequentially performing cases 1 and 2 when the refrigerant is unequally introduced to an evaporator, as shown in table 2, may be obtained through a repeated experiment.

For convenience in description, a control time of the flow adjuster 130 according to case 1 as shown in Tables 1 and 2 may be referred to as "a first set or predetermined time", and a control time of the flow adjuster 130 according to case 2 as shown in Tables 1 and 2 may be referred to as "a second set or predetermined time".

The refrigerator 10 may include a target temperature setting device 290 to which a target temperature of the refrigerator compartment or the freezer compartment may be input. For example, the target temperature setting device 290 may be disposed on a front surface of the door of the refrigerator compartment or the freezer compartment, in a location where a user may conveniently manipulate the target temperature setting device 290.

Information input through the target temperature setting device 290 may be used as control reference information for the compressor 110, the blower fans 125, 155, and 165, or the flow adjuster 130. That is, based on information input through the target temperature setting device 290, and information sensed at the storage temperature sensor 250, the controller 200 may determine whether to perform the simultaneous cooling operation on the refrigerator compartment and the freezer compartment, a single operation on any one of the refrigerator compartment and the freezer compartment, or turning off of the compressor 110.

For example, when the inner temperatures of the refrigerator compartment and the freezer compartment are higher than temperatures input through the target temperature setting device 290, the controller 200 may control the compressor 110 and the flow adjuster 130 to perform the simultaneous cooling operation. When the inner temperature of the freezer compartment is higher than a temperature input through the target temperature setting device 290, and the inner temperature of the refrigerator compartment is lower than a temperature input through the target temperature setting device 290, the controller 200 may control the compressor 110 and the flow adjuster 130 to perform a single operation on the freezer compartment. When the inner temperatures of the refrigerator compartment and the freezer compartment are lower than temperatures input through the target temperature setting device 290, the controller 200 may turn the compressor 110 off.

Figure 3:
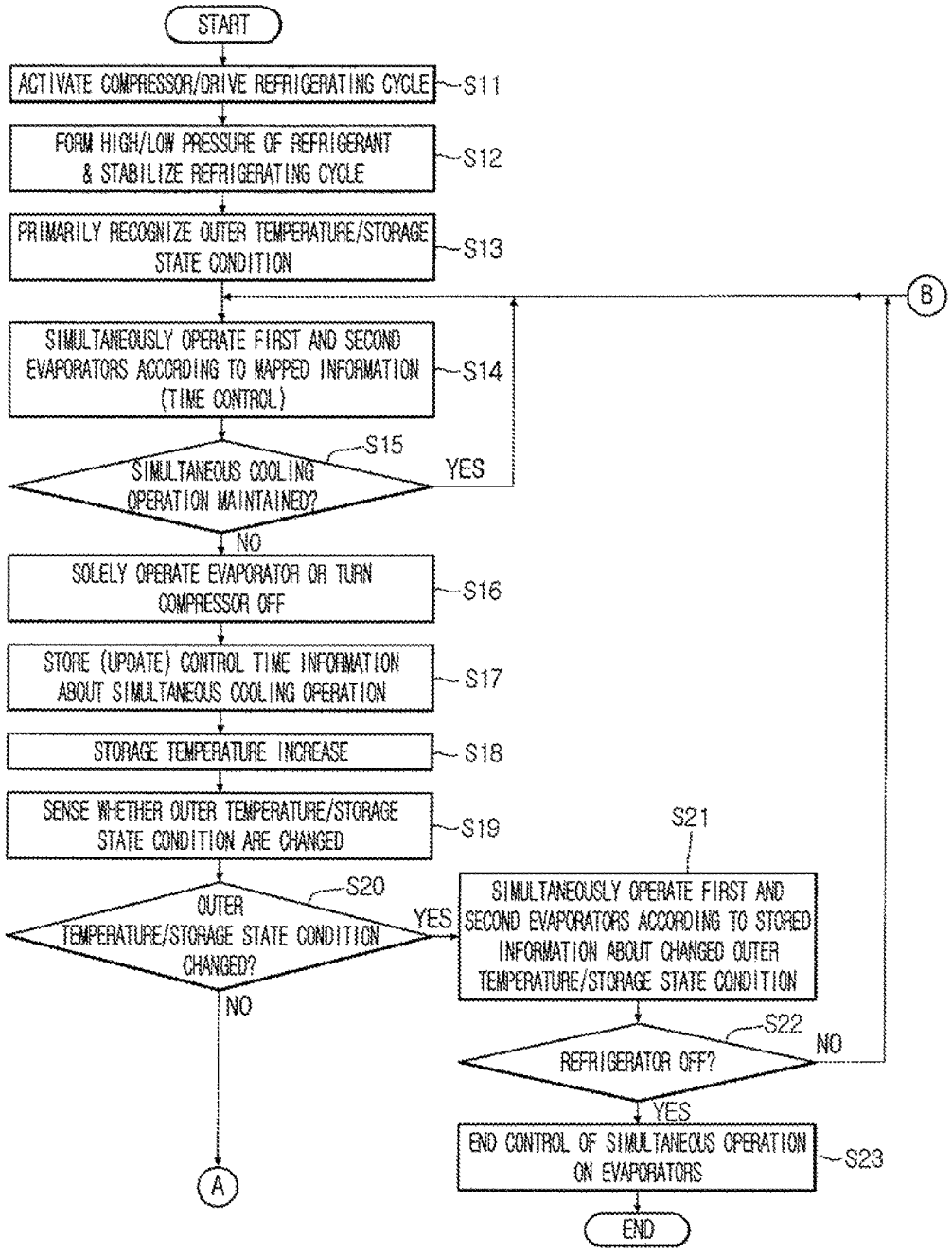
FIGS. 3 and 4 are flowcharts of a method for controlling a refrigerator according to an embodiment.
Figure 4:
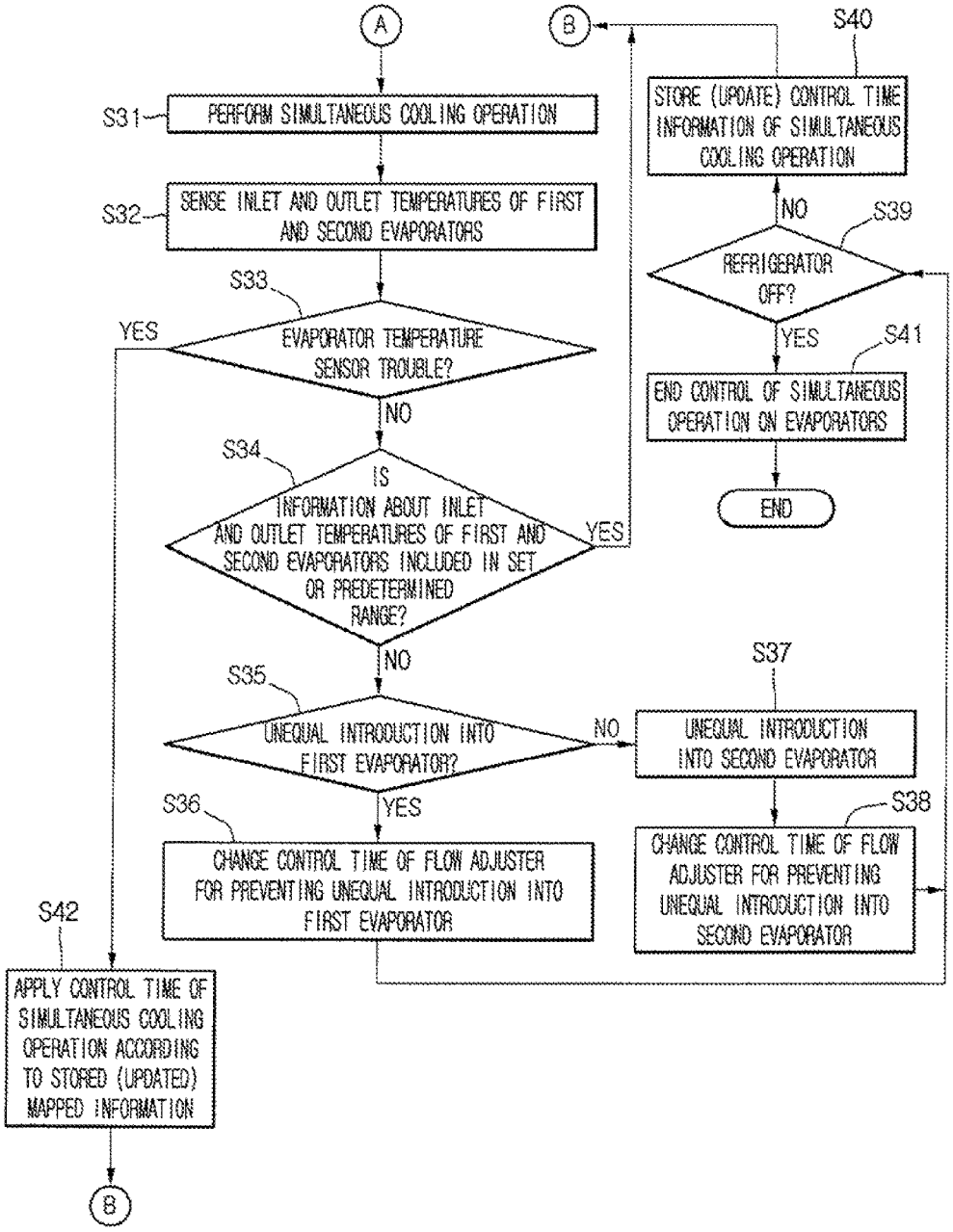

FIGS. 3 and 4 are flowcharts illustrating a method for controlling a refrigerator according to an embodiment. Referring to FIGS. 3 and 4, a method for controlling refrigerator 10 according to this embodiment will be discussed hereinbelow.

First, in step S11, the compressor 110 (first and second compressors 111 and 115) may be activated to operate the refrigerator 10. As the compressor 110 is activated, the refrigerating cycle may be driven according to compression, condensation, expansion, and evaporation of the refrigerant. The refrigerant evaporated at the second evaporator 160 may be compressed at the second compressor 115, join the refrigerant evaporated at the first evaporator 150, and be introduced into the first compressor 111.

At this point, the compressor 110 is in an initial stage according to the driving of the refrigerating cycle. When a predetermined period of time has elapsed, pressure values according to refrigerant circulation may reach set or predetermined ranges. That is, high pressures of the refrigerant discharged from the first and second compressors 111 and 115, and low pressures of the refrigerant discharged from the first and second evaporators 150 and 160 reach the set or predetermined ranges.

When the high and low pressures of the refrigerant are within the set or predetermined ranges, the refrigerating cycle may be stabilized and continually driven. At this point, a target temperature of the storage in the refrigerator 10 may be preset or predetermined, in step S12.

During the driving of the refrigerating cycle, the temperature sensors 250 and 260 may primarily sense temperature conditions related to the inner temperature of the storage and the outer temperature of the refrigerator 10. An outer temperature condition and a storage state condition, as shown in Table 1, may be determined considering the sensed temperature conditions and whether the compressor 110 is activated, in step S13.

When the outer temperature condition and the storage state condition are determined, the simultaneous cooling operation may be performed on the refrigerator compartment and the freezer compartment according to the mapped information, as shown in Table 1. That is, a time control operation may be performed according to case 1 to prevent the refrigerant from being unequally introduced to the second evaporator 160, and then, a time control operation may be performed according to case 2 to prevent the refrigerant from being unequally introduced to the first evaporator 150, in step S14.

When cooling operations are performed once according to cases 1 and 2, whether the simultaneous cooling operation on the refrigerator compartment and the freezer compartment is maintained may be recognized. In particular, the storage temperature sensor 250 may sense whether the temperature of the refrigerator compartment or the freezer compartment reaches the target temperature.

When the temperature of the refrigerator compartment or the freezer compartment reaches the target temperature, cooling of the storage in the refrigerator compartment or the freezer compartment is unnecessary, and thus, the simultaneous cooling operation is also unnecessary. Thus, the storage in the refrigerator compartment or the freezer compartment, the temperature of which does not reach the target temperature, may be solely cooled, that is, the evaporator corresponding to the storage may be solely operated. When the temperatures of the refrigerator compartment and the freezer compartment reach the target temperatures, the operation of the compressor 110 may be turned off.

When the temperatures of the refrigerator compartment and the freezer compartment do not reach the target temperatures, step S14 may be performed again to again simultaneously operate the first and second evaporators 150 and 160. The simultaneous operation may be repeated until at least one of the refrigerator compartment or the freezer compartment reaches the target temperature, in steps S15 and S16.

When the simultaneous operation in step S14 and the operation in step S16 are completed, information about operation time performed in each operation may be stored in the memory 280. That is, the operations in steps S14 to S16 may be repeated as a cycle, and the information about the operation time in step S14 and the information about the operation time in step S16 may be stored while the refrigerator 10 is continually operated.

The operation times stored in a current control operation may be updated to operation times stored in a next control operation. An updated operation time, that is, a switching operation time of the flow adjuster 130 may be used as information for a time control in an emergency, for example, when the temperature sensors 210, 220, 230 and 240 to sense the inlet temperatures and the outlet temperatures of the first evaporator 150 and the second evaporator 160 are malfunctioning or broken, in step S17.

When a time has elapsed from step S16 during which the evaporator is solely operated or the operation of the compressor 110 is turned off, the temperature of the refrigerator compartment or the freezer compartment may increase. When the temperature of the refrigerator compartment or the freezer compartment exceeds a target temperature range, cooling of a storage in the refrigerator compartment or the freezer compartment, or cooling activation of the compressor 110 from the off state may be needed. At this point, it may be sensed whether the outer temperature condition or the storage state condition as shown in Table 1 is changed or not.

That is, it may be sensed whether the outer temperature has changed so as to be out of a control reference range, for example, the outer temperature is changed from about 17° C. to 15° C., whether the cooling activation of the compressor 110 may be performed from the off state, whether a load reaction of a storage occurs, or whether the simultaneous cooling of the refrigerator compartment and the freezer compartment is needed, in steps S18 and S19. When the outer temperature condition or the storage state condition has not changed, that is, when the outer temperature condition or the storage state condition recognized in step S13 has not changed, operations after "A" as illustrated in FIG. 4 may be performed. In contrast, when the outer temperature condition or the storage state condition is changed, that is, when the outer temperature condition or the storage state condition recognized in step S13 has changed, a simultaneous cooling operation may be performed on the first and second evaporators 150 and 160 according to cases 1 and 2 and the mapped information of the changed outer temperature condition or the changed storage state condition, in steps S20 and S21.

Thus, as the refrigerator 10 is a product that is driven at all times, while on and off operations of the compressor 110 are repeated, and a temperature of the storage in the refrigerator 10 is changed after electric power is applied to the refrigerator 10, the flow adjuster 130 may be repeatedly controlled according to cases 1 and 2 based on the mapped information of the outer temperature conditions and the storage state conditions as shown in Table 1. The method for controlling the refrigerator 10 may be performed until the refrigerator 10 is turned off to end the simultaneous operation (time controls) of the first and second evaporators 150 and 160, in steps S22 and S23. As such, while the simultaneous operation of the first and second evaporators 150 and 160 is performed, controls of the flow adjuster 130 to prevent the refrigerant from being unequally introduced to the first and second evaporators 150 and 160 may be sequentially performed according to cases 1 and 2, thereby improving cooling efficiency of the storage of the refrigerator 10 and operation efficiency of the refrigerator 10.

When the outer temperature condition or the storage state condition has not changed in step S20, whether a control time has changed may be determined based on the inlet temperatures and the outlet temperatures of the first and second evaporators 150 and 160. In particular, referring to FIG. 4, when the outer temperature condition or the storage state condition has not changed in step S20, the simultaneous cooling operation may be performed again on the refrigerator compartment and the freezer compartment, based on the outer temperature condition and the storage state condition recognized in step S13, in step S31.

While the simultaneous cooling operation is performed again, whether control times of the flow adjuster 130 according to cases 1 and 2 have changed may be determined. In particular, the inlet temperature and the outlet temperature of the first evaporator 150 may be sensed by the first inlet temperature sensor 210 and the first outlet temperature sensor 220. In addition, the inlet temperature and the outlet temperature of the second evaporator 160 may be sensed by the second inlet temperature sensor 230 and the second outlet temperature sensor 240, in step S32.

Whether the first inlet temperature sensor 210 or the first outlet temperature sensor 220 of the first evaporator 150, or the second inlet temperature sensor 230 or the second outlet temperature sensor 240 of the second evaporator 160 has malfunctioned or has a failure or problem may be recognized based on temperature information sensed thereby. For example, when the temperature information sensed by the temperature sensors 210, 220, 230, and 240 is included in an abnormal range, that is, when the temperature information is out of a range (a range limit) allowed during the driving of the refrigerating cycle, it may be recognized that the temperature sensor 210, 220, 230, or 240 has malfunctioned or has a failure or problem.

When it is not recognized that the temperature sensor 210, 220, 230, or 240 has malfunctioned or has a failure or problem, the controller 200 may determine a difference value between the inlet and outlet temperatures of the first evaporator 150, and a difference value between the inlet and outlet temperatures of the second evaporator 160. When the amount of the refrigerant introduced into the first evaporator 150 or the second evaporator 160 is equal to or greater than an appropriate or predetermined refrigerant amount, a difference between the inlet and outlet temperatures of the first or second evaporator 150 or 160 decreases. In contrast, when the amount of the refrigerant introduced into the first evaporator 150 or the second evaporator 160 is smaller than the appropriate or predetermined refrigerant amount, the difference between the inlet and outlet temperatures of the first or second evaporator 150 or 160 increases.

The controller 200 may recognize whether information about the difference between the inlet and outlet temperatures of the first and second evaporators 150 and 160 is within a set or predetermined range. The "set or predetermined range" may be understood as a range used to recognize whether the refrigerant is unequally introduced to any one of the first evaporator 150 or the second evaporator 160.

That is, whether the refrigerant flowing through the first evaporator 150 or the second evaporator 160 is excessive or insufficient, that is, whether the refrigerant is unequally introduced to the first evaporator 150 or the second evaporator 160 may be recognized by the controller 200 based on the difference between the inlet and outlet temperatures of the first and second evaporators 150 and 160. In particular, whether the refrigerant flowing through the first evaporator 150 or the second evaporator 160 is excessive or insufficient may be determined based on one of the difference between the inlet and outlet temperatures of the first evaporator 150, a difference value between the difference between the inlet and outlet temperatures of the first evaporator 150 and the difference between the inlet and outlet temperatures of the second evaporator 160, and a ratio value between the difference between the inlet and outlet temperatures of the first evaporator 150 and the difference between the inlet and outlet temperatures of the second evaporator 160, in step S34.

The determination will now be described in detail hereinbelow.

For example, whether the refrigerant is unequally introduced may be determined according to whether the difference between the inlet and outlet temperatures of the first evaporator 150 is equal to, greater than, or smaller than a preset or predetermined reference value. The flow adjuster 130 may divide the refrigerant circulating through the refrigerating cycle into flows to the first evaporator 150 and the second evaporator 160. Thus, when the difference between the inlet and outlet temperatures of the first evaporator 150 is sensed, a ratio of the refrigerant passing through the first evaporator 150 may be recognized. A ratio of the refrigerant passing through the second evaporator 160 may be recognized based on the ratio of the refrigerant passing through the first evaporator 150.

For example, when the difference between the inlet and outlet temperatures of the first evaporator 150 is greater than the preset or predetermined reference value, it may be determined that the amount of the refrigerant introduced to the first evaporator 150 is insufficient, and it may be recognized that the amount of the refrigerant introduced to the second evaporator 160 is relatively large.

A method for determining whether the refrigerant is unequally introduced, using the difference between the inlet and outlet temperatures of the first evaporator 150 is described according to this embodiment. Alternatively, whether the refrigerant is unequally introduced may be determined using the difference between the inlet and outlet temperatures of the second evaporator 160.

When the difference between the inlet and outlet temperatures of the first evaporator 150 is equal to the preset or predetermined reference value (a reference temperature), it may be recognized that the refrigerant is not unequally introduced to the first or second evaporator 150 or 160. In this case, step S14 may be performed again to control the flow adjuster 130, based on information stored in the memory 280, that is, mapped information corresponding to the simultaneous cooling operation. That is, as shown Table 2, adjustment states according to cases 1 and 2 may be maintained for t1 and t2, respectively.

When the difference between the inlet and outlet temperatures of the first evaporator 150 is not equal to the preset or predetermined reference value and is larger or smaller than the preset or predetermined reference value, it is recognized that the refrigerant is unequally introduced to the first or second evaporator 150 or 160. In particular, when the difference between the inlet and outlet temperatures of the first evaporator 150 is smaller than the preset or predetermined reference value, it is recognized that a relatively large amount of the refrigerant passes through the first evaporator 150. That is, it is recognized that the refrigerant is unequally introduced into the first evaporator 150.

This case corresponds to a condition "unequal introduction of refrigerant to first evaporator" of Table 2, and a control state of the flow adjuster 130 according to case 1 may be maintained for t1 and a control state of the flow adjuster 130 according to case 2 may be maintained for t1+α. That is, an adjustment time of the flow adjuster 130 according to case 2 under the condition "unequal introduction of refrigerant to first evaporator" may be increased relative to an adjustment time of the flow adjuster 130 according to case 2 under a condition "start of simultaneous cooling operation", thereby relatively decreasing the amount of the refrigerant introduced into the first evaporator 150, in steps S35 and S36.

When the difference between the inlet and outlet temperatures of the first evaporator 150 is greater than the preset or predetermined reference value, it is recognized that a relatively small amount of the refrigerant passes through the first evaporator 150. That is, it is recognized that the refrigerant is unequally introduced into the second evaporator 160.

This case corresponds to a condition "unequal introduction of refrigerant to second evaporator" of Table 2, and the control state of the flow adjuster 130 according to case 1 may be maintained for t1, and the control state of the flow adjuster 130 according to case 2 may be maintained for t1−α. That is, an adjustment time of the flow adjuster 130 according to case 2 under the condition "unequal introduction of refrigerant to second evaporator" may be decreased relative to the adjustment time of the flow adjuster 130 according to case 2 under the condition "start of simultaneous cooling operation", thereby relatively increasing the amount of the refrigerant introduced into the first evaporator 150.

As such, the control times of the flow adjuster 130 may be changed based on the information about the difference between the inlet and outlet temperatures of the first and second evaporators 150 and 160, thereby preventing the refrigerant from being unequally introduced into the first evaporator 150 or the second evaporator 150 or 160, in steps S37 and S38.

When the control times of the flow adjuster 130 are changed according to the above described method, values of the changed control times may be stored in the memory 280 or be used to update the memory 280, and step S14 may be performed again until the refrigerator 10 is turned off to end a control of the simultaneous operation on the first and second evaporators 150 and 160. At this point, information stored or updated in the memory 280 may include time information, based on which the flow adjuster 130 may be actually operated (switched), and may be used later as information for a time control in an emergency, steps S39, S40, and S41.

As another example of the determination in step S34, whether the refrigerant is unequally introduced may be determined according to whether a ratio of the difference between the inlet and outlet temperatures of the first evaporator 150 to the difference between the inlet and outlet temperatures of the second evaporator 160 is equal to, greater than, or smaller than a first set or predetermined value. For example, the first set or predetermined value may be 1.

When the ratio of the difference between the inlet and outlet temperatures of the first evaporator 150 to the difference between the inlet and outlet temperatures of the second evaporator 160 is 1, that is, when the difference between the inlet and outlet temperatures of the first evaporator 150 is the same as the difference between the inlet and outlet temperatures of the second evaporator 160, it may be recognized that the refrigerant is equally introduced into the first and second evaporators 150 and 160. When the ratio of the difference between the inlet and outlet temperatures of the first evaporator 150 to the difference between the inlet and outlet temperatures of the second evaporator 160 is greater than 1, that is, when the difference between the inlet and outlet temperatures of the first evaporator 150 is greater than the difference between the inlet and outlet temperatures of the second evaporator 160, it may be recognized that the refrigerant is unequally introduced into the second evaporator 160. When the ratio of the difference between the inlet and outlet temperatures of the first evaporator 150 to the difference between the inlet and outlet temperatures of the second evaporator 160 is smaller than 1, that is, when the difference between the inlet and outlet temperatures of the first evaporator 150 is smaller than the difference between the inlet and outlet temperatures of the second evaporator 160, it may be recognized that the refrigerant is unequally introduced into the first evaporator 150.

As another example of the determination in step S34, whether the refrigerant is unequally introduced may be determined according to whether the difference value between the difference between the inlet and outlet temperatures of the first evaporator 150 and the difference between the inlet and outlet temperatures of the second evaporator 160 is equal to, greater than, or smaller than a second set or predetermined value. For example, the second set or predetermined value may be 0. When a value obtained by subtracting the difference between the inlet and outlet temperatures of the second evaporator 160 from the difference between the inlet and outlet temperatures of the first evaporator 150 is 0, that is, when the difference between the inlet and outlet temperatures of the first evaporator 150 is the same as the difference between the inlet and outlet temperatures of the second evaporator 160, it may be recognized that the refrigerant is equally introduced into the first and second evaporators 150 and 160.

When the value obtained by subtracting the difference between the inlet and outlet temperatures of the second evaporator 160 from the difference between the inlet and outlet temperatures of the first evaporator 150 is greater than 0, that is, when the difference between the inlet and outlet temperatures of the first evaporator 150 is greater than the difference between the inlet and outlet temperatures of the second evaporator 160, it may be recognized that the refrigerant is unequally introduced into the second evaporator 160. When the value obtained by subtracting the difference between the inlet and outlet temperatures of the second evaporator 160 from the difference between the inlet and outlet temperatures of the first evaporator 150 is smaller than 0, that is, when the difference between the inlet and outlet temperatures of the first evaporator 150 is smaller than the difference between the inlet and outlet temperatures of the second evaporator 160, it may be recognized that the refrigerant is unequally introduced into the first evaporator 150.

When it is recognized in step S33 that the temperature sensor 210, 220, 230, or 240 has malfunctioned, or has a failure or problem, control time information previously stored in the simultaneous cooling operation, that is, previous operation (switching) time information of the flow adjuster 130 may be applied to a subsequent refrigerant operation. Then, step S14 may be performed again to perform the simultaneous cooling operation on the first and second evaporators 150 and 160, based on the stored operation time information of the flow adjuster 130, in step S42.

According to the method for controlling the refrigerator 10, when a temperature sensor disposed on an evaporator has a problem in an operation performed based on control time information of the flow adjuster 130, as shown in Table 1, and changed control time information, as shown in Table 2, time information may be used to control the operation of the flow adjuster 130, thereby stably and continually operating the refrigerator 10. That is, it is unnecessary to re-perform an initial control method using the time values as shown in Table 1.

Hereinafter, descriptions will be made according to another embodiment. Different components between the previous embodiment and this embodiment will be primarily described, and repetitive description of the same or similar components will be omitted. Also like reference numerals denote like elements throughout.

Figure 5:
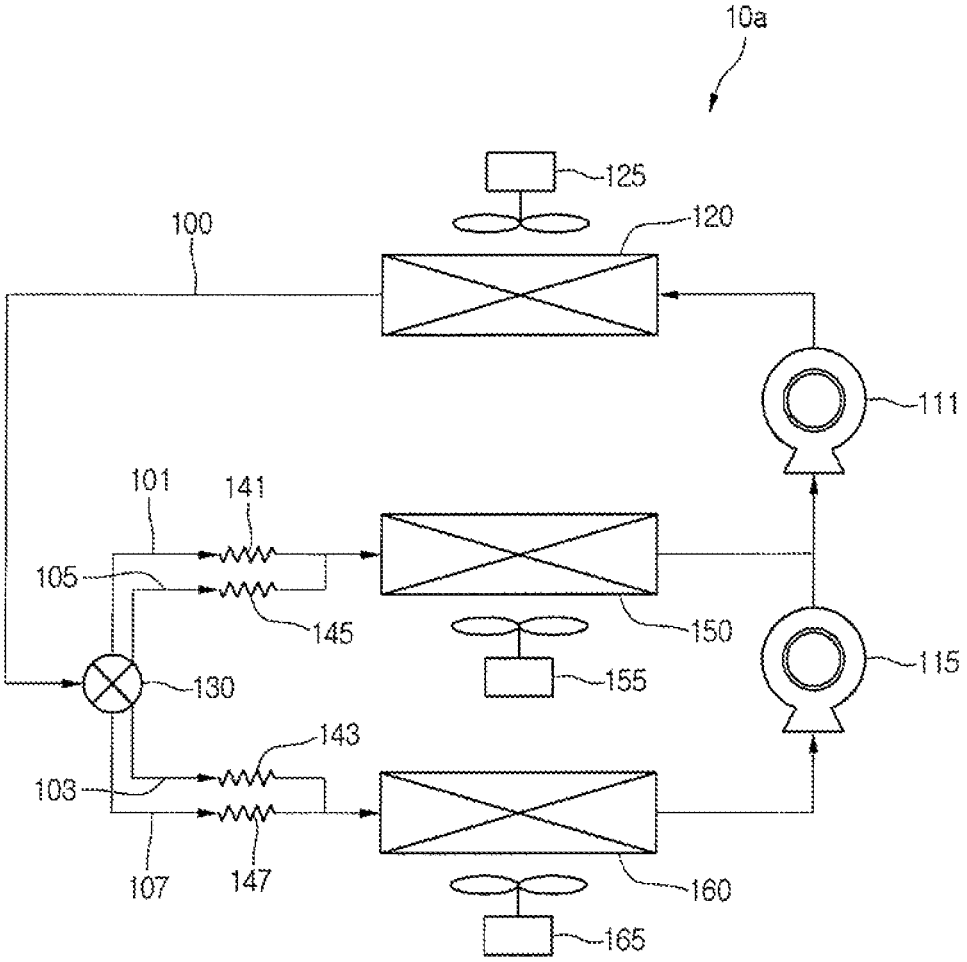
FIG. 5 is a schematic diagram of a refrigerating cycle of a refrigerator according to another embodiment.

FIG. 5 is a schematic diagram of a refrigerating cycle of a refrigerator according to another embodiment. Referring to FIG. 5, refrigerator 10*a* according to this embodiment may include refrigerant pipe arrangement 100 to guide a flow of refrigerant condensed at condenser 120, flow adjuster 130 installed on the refrigerant pipe arrangement 100 and dividing the refrigerant into flows to first and second evaporators 150 and 160, and a plurality of refrigerant passages 101, 103, 105, and 107 that extends from an outlet side of the flow adjuster 130 to the first and second evaporators 150 and 160.

The refrigerant passages 101, 103, 105, and 107 may be understood as "branch passages" that diverge from the refrigerant pipe arrangement 100 and may include first and third refrigerant passages 101 and 105 connected to the first evaporator 150, and second and fourth refrigerant passages 103 and 107 connected to the second evaporator 160. The first and third refrigerant passages 101 and 105 may guide the refrigerant to be introduced into the first evaporator 150, and thus, may be referred to as "first evaporation passages". The second and fourth refrigerant passages 103 and 107 may guide the refrigerant to be introduced into the second evaporator 160 and thus, may be referred to as "second evaporation passages".

The refrigerant flowing through the first refrigerant passage 101 and the refrigerant flowing through the third refrigerant passage 105 may join each other, and then, may be introduced into the first evaporator 150. The refrigerant flowing through the second refrigerant passage 103 and the refrigerant flowing through the fourth refrigerant passage 107 may join each other, and then, may be introduced into the second evaporator 160. As described according to the previous embodiment, the refrigerant discharged from the second evaporator 160 may be introduced into second compressor 115, and the refrigerant compressed at the second compressor 115 may join the refrigerant discharged from the first evaporator 150 and be introduced into first compressor 111.

A plurality of expansion devices 141, 143, 145, and 147 may be disposed on the refrigerant passages 101, 103, 105, and 107. The plurality of expansion devices 141, 143, 145, and 147 may include capillary tubes. In particular, the plurality of expansion devices 141, 143, 145, and 147 may include a first expansion device 141 disposed on the first refrigerant passage 101, a second expansion device 143 disposed on the second refrigerant passage 103, a third expansion device 145 disposed on the third refrigerant passage 105, and a fourth expansion device 147 disposed on the fourth refrigerant passage 107.

The flow adjuster 130 may include a five-way valve, which may include an inflow, through which the refrigerant may be introduced, and four outflows, through which the refrigerant may be discharged. The first to fourth refrigerant passages 101, 103, 105, and 107 may be connected to the four outflows. At least one of the first refrigerant passage 101 and the third refrigerant passage 105, and at least one of the second refrigerant passage 103 and the fourth refrigerant passage 107 may be opened according to a control of the flow adjuster 130. Alternatively, any one of the first evaporation passages 101 and 105 and the second evaporation passages 103 and 107 may be closed.

For example, the first to third refrigerant passages 101, 103, and 105 may be open, and the fourth refrigerant passage 107 may be closed. In this case, an amount of the refrigerant introduced into the first evaporator 150 may be greater than an amount of the refrigerant introduced into the second evaporator 160. Alternatively, the first, second, and fourth refrigerant passages 101, 103, and 107 may be open, and the third refrigerant passage 105 may be closed. In this case, an amount of the refrigerant introduced into the second evaporator 160 may be greater than an amount of the refrigerant introduced into the first evaporator 150.

As such, a plurality of refrigerant passages and a plurality of expansion devices may be disposed at an inlet side of the first and second evaporators 150 and 160, and at least one of the refrigerant passages may be opened or closed according to whether refrigerant introduced into the first and second evaporators 150 and 160 is excessive or insufficient, thereby controlling a flow rate of the refrigerant. Thus, while a plurality of evaporators are simultaneously operated, refrigerant may be prevented from being unequally introduced into any one of the evaporators.

The description of the method as illustrated in FIGS. 3 and 4 may be applied to a method for controlling a refrigerator according to this embodiment. However, this embodiment and the previous embodiment are different in a control state of the flow adjuster 130 according to cases 1 and 2. In particular, when the flow adjuster 130 is controlled such that the first to third refrigerant passages 101, 103, and 105 are open, and the fourth refrigerant passage 107 is closed, the amount of the refrigerant introduced into the first evaporator 150 may relatively increase. In this case, time controls according to case 1 as shown in Tables 1 and 2 may be used.

When the flow adjuster 130 is controlled such that the first, second, and fourth refrigerant passages 101, 103, and 107 are open, and the third refrigerant passage 105 is closed, the amount of the refrigerant introduced into the second evaporator 160 may relatively increase. In this case, time controls according to case 2 as shown in Tables 1 and 2 may be used.

As such, as the flow adjuster 130 is controlled to adjust amounts of the refrigerant passing through the first evaporation passages 101 and 105 and the second evaporation passages 103 and 107, the refrigerant may be prevented from being unequally introduced into the first or second evaporator 150 or 160, thus improving cooling efficiency and decreasing power consumption.

Figure 6:
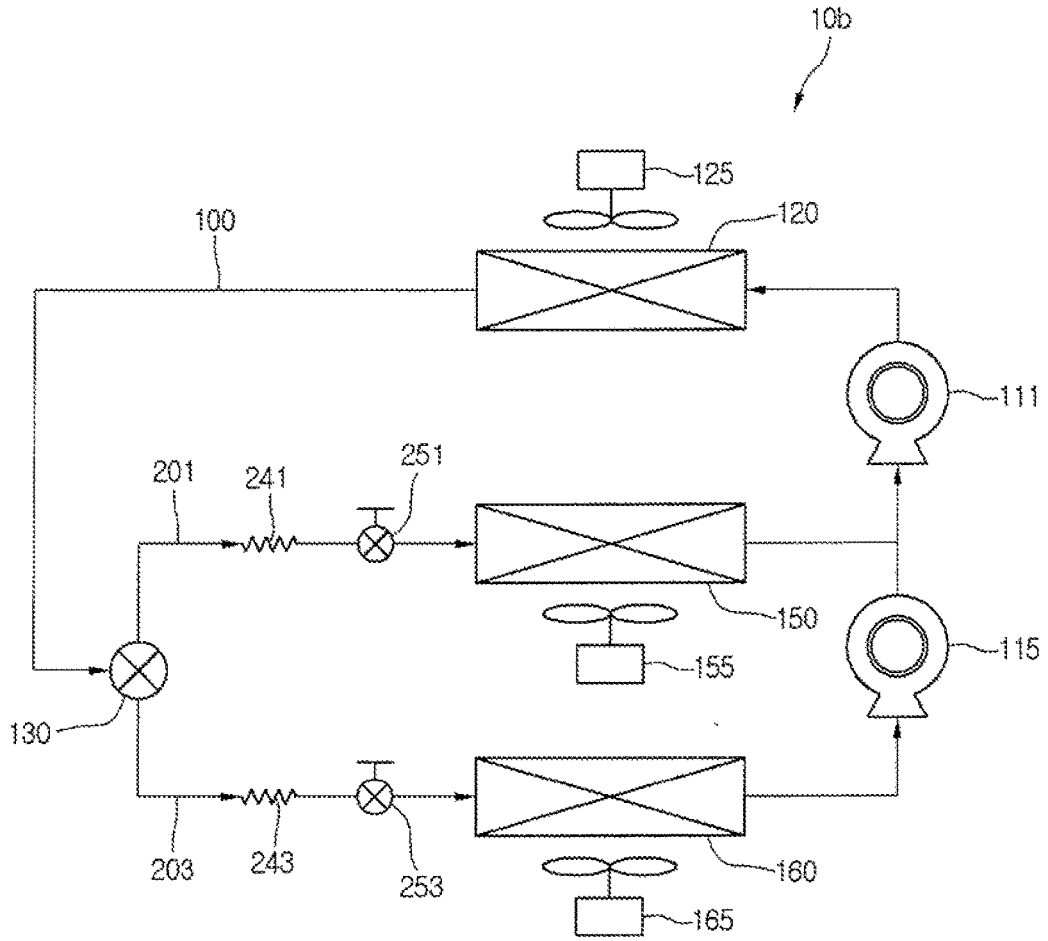
FIG. 6 is a schematic diagram of a refrigerating cycle of a refrigerator according to another embodiment.

FIG. 6 is a schematic diagram of a refrigerating cycle of a refrigerator according to another embodiment. Referring to FIG. 6, refrigerator 10*b* according to this embodiment may include refrigerant pipe arrangement 100 to guide a flow of refrigerant condensed at condenser 120, flow adjuster 130 installed on the refrigerant pipe arrangement 100 and dividing the refrigerant into flows to first and second evaporators 150 and 160, and a plurality of refrigerant passages 201 and 203 that extends from an outlet side of the flow adjuster 130 to the first and second evaporators 150 and 160.

The plurality of refrigerant passages 201 and 203 may be understood as "branch passages" that diverge from the refrigerant pipe arrangement 100 and may include a first refrigerant passage 201 connected to the first evaporator 150, and a second refrigerant passage 203 connected to the second evaporator 160. A plurality of expansion devices 241 and 243 may be disposed on the refrigerant passages 201 and 203, respectively. The plurality of expansion devices 241 and 243 may include capillary tubes. In particular, the plurality of expansion devices 241 and 243 may include a first expansion device 241 disposed on the first refrigerant passage 201, and a second expansion device 243 disposed on the second refrigerant passage 203.

The flow adjuster 130 may include a three-way valve, which may include an inflow, through which the refrigerant may be introduced, and two outflows, through which the refrigerant may be discharged. The first and second refrigerant passages 201 and 203 may be connected to the two outflows. The flow adjuster 130 may be controlled such that the refrigerant may be simultaneously introduced into the first and second refrigerant passages 201 and 203.

The refrigerator 10*b* may include at least one flow rate adjuster 251 and 253 to adjust flows of the refrigerant. The flow rate adjusters 251 and 253 may be installed on at least one of the first refrigerant passage 201 or the second refrigerant passage 203. For example, the flow rate adjusters 251 and 253 may include a first flow rate adjuster 251 installed on the first refrigerant passage 201, and a second flow rate adjuster 253 installed on the second refrigerant passage 203. The first and second flow rate adjusters 251 and 253 may include an electric expansion valve (EEV) to adjust degrees of opening of the first and second flow rate adjusters 251 and 253.

Referring to FIG. 6, the first and second flow rate adjusters 251 and 253 may be disposed at outlet sides of the first and second expansion devices 241 and 243, respectively. However, the first and second flow rate adjusters 251 and 253 may be disposed at inlet sides of the first and second expansion devices 241 and 243, respectively.

When the opening degree of the first or second flow rate adjusters 251 or 253 is decreased, an amount of the refrigerant flowing through the opening decreases. When the opening degree of the first or second flow rate adjusters 251 or 253 is increased, the amount of the refrigerant flowing through the opening increases.

For example, when the opening degree of the first flow rate adjuster 251 is greater than the opening degree of the second flow rate adjuster 253, a larger amount of the refrigerant flows through the first refrigerant passage 201 to increase an amount of the refrigerant introduced into the first evaporator 150. In contrast, when the opening degree of the second flow rate adjuster 253 is greater than the opening degree of the first flow rate adjuster 251, a larger amount of the refrigerant flows through the second refrigerant passage 203 to increase an amount of the refrigerant introduced into the second evaporator 160.

The first and second flow rate adjusters 251 and 253 may minutely adjust an opening degree of a refrigerant passage, so as to minutely adjust an amount of the refrigerant to be introduced into the first evaporator 150 or the second evaporator 160. As a result, while the first and second evaporators 150 and 160 are simultaneously operated, the refrigerant may be prevented from being unequally introduced into the first or second evaporator 150 or 160.

Referring to FIG. 6, the first and second flow rate adjusters 251 and 253 are shown disposed on the first and second refrigerant passages 201 and 203, respectively. However, a flow rate adjuster may be disposed on only one of the first or second refrigerant passage 201 or 203.

A flow rate adjuster may be provided on any one of refrigerant passages to adjust an opening degree thereof, thereby relatively adjusting an amount of refrigerant passing through the other. That is, when an opening degree of the flow rate adjuster increases, the amount of the refrigerant passing through the second refrigerant passage may decrease. When the opening degree of the flow rate adjuster decreases, the amount of the refrigerant passing through the second refrigerant passage may increase.

The flow rate adjusters 251 and 253 may be individually provided on the refrigerant passages 101, 103, 105, and 107 as described according to the previous embodiments. In this case, a flow rate of the refrigerant may be minutely adjusted.

The description of the method as illustrated in FIGS. 3 and 4 may be applied to a method for controlling a refrigerator according to this embodiment. However, this embodiment and the previous embodiment are different in control state of the first and second flow rate adjusters 251 and 253 according to cases 1 and 2. In particular, when the first and second flow rate adjusters 251 and 253 are controlled such that an amount of the refrigerant flowing through the first refrigerant passage 201 is greater than an amount of the refrigerant flowing through the second refrigerant passage 203, the time controls according to case 1 as shown in Tables 1 and 2 may be used. For example, the opening degree of the first flow rate adjuster 251 may be controlled to be greater than the opening degree of the second flow rate adjuster 253.

When the first and second flow rate adjusters 251 and 253 are controlled such that the amount of the refrigerant flowing through the second refrigerant passage 203 is greater than the amount of the refrigerant flowing through the first refrigerant passage 201, the time controls according to case 2 as shown in Tables 1 and 2 may be used. For example, the opening degree of the second flow rate adjuster 253 may be controlled to be greater than the opening degree of the first flow rate adjuster 251.

As such, as the flow adjuster 130 and the opening degrees of the first and second flow rate adjusters 251 and 253 may be controlled to adjust the amounts of the refrigerant passing through the first and second refrigerant passages 201 and 203, the refrigerant may be prevented from being unequally introduced into the first or second evaporator 150 or 160, thus improving cooling efficiency and decreasing power consumption.

Figure 7:
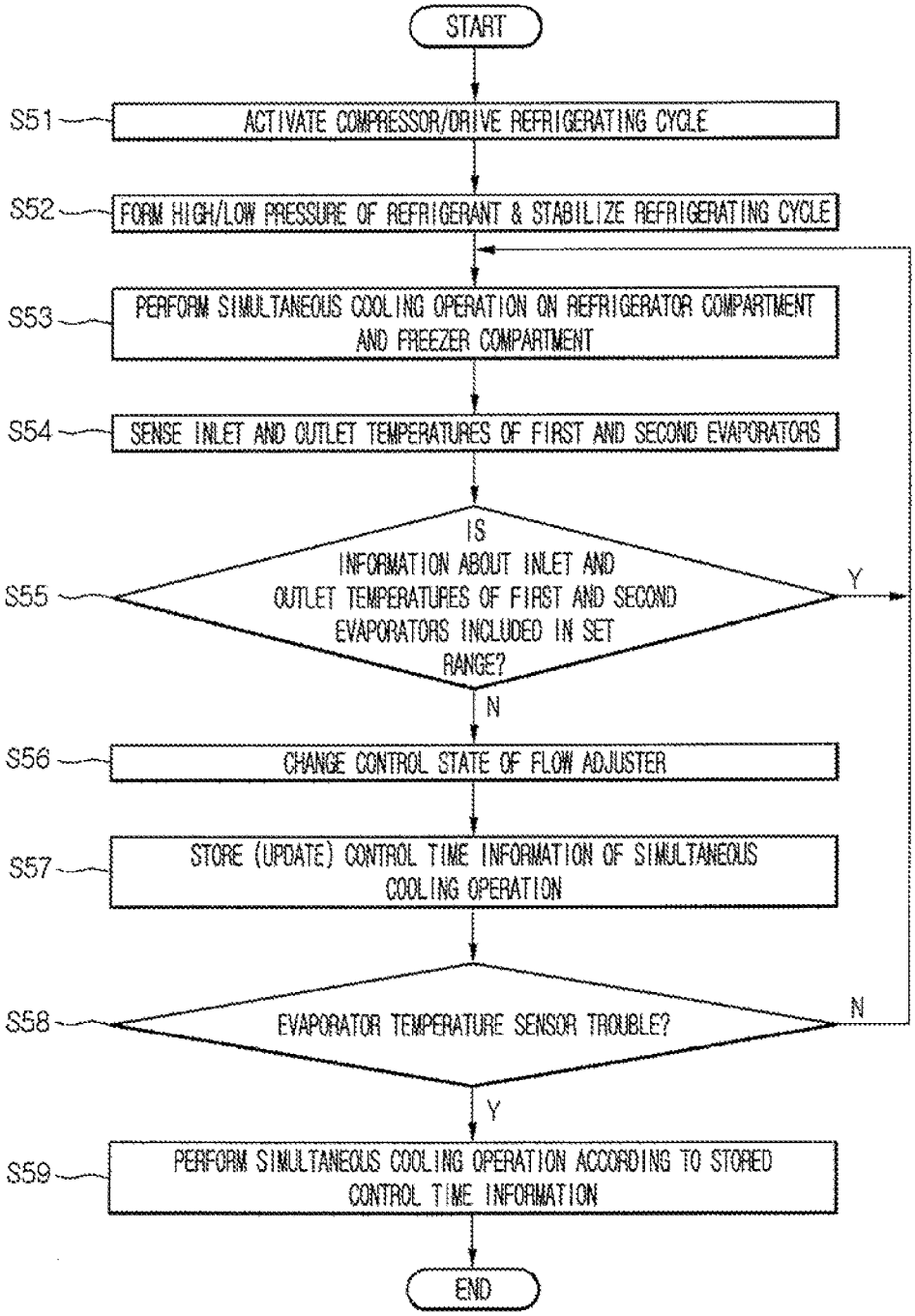
FIG. 7 is a flowchart of a method for controlling a refrigerator according to another embodiment.

FIG. 7 is a flowchart of a method for controlling a refrigerator according to another embodiment. Referring to FIG. 7, a method for controlling a refrigerator will now be described according to this embodiment.

Compressor 110 (first and second compressors 111 and 115) may be activated to operate the refrigerator. As the compressor 110 is activated, a refrigerating cycle may be driven according to compression, condensation, expansion, and evaporation of refrigerant. The refrigerant evaporated at second evaporator 160 may be compressed at the second compressor 115, join the refrigerant evaporated at first compressor 150, and be introduced into the first compressor 111, in step S51.

A simultaneous cooling operation may be performed on a refrigerator compartment and a freezer compartment in an initial stage according to the driving of the refrigerating cycle. When a predetermined period of time has elapsed, a pressure value according to refrigerant circulation may reach a set or predetermined range. That is, high pressures of the refrigerant discharged from the first and second compressors 111 and 115, and low pressures of the refrigerant discharged from the first and second evaporators 150 and 160 may reach set or predetermined ranges.

When the high and low pressures of the refrigerant reach the set or predetermined ranges, the refrigerating cycle may be stabilized and continually driven. At this point, a target temperature of a storage in the refrigerator may be preset or predetermined, in step S52.

When the refrigerating cycle is driven, the simultaneous cooling operation may be performed to simultaneously cool the refrigerator compartment and the freezer compartment. The simultaneous cooling operation may be performed when a temperature of the refrigerator compartment and a temperature of the freezer compartment are higher than target temperatures, in step S53. In addition, when the temperature of a storage in any one of the refrigerator compartment and the freezer compartment reaches the target temperature, a cooling operation on the storage may be stopped.

While the simultaneous cooling operation is performed, a plurality of temperature sensors 210, 220, 230, and 240 may sense inlet and outlet temperatures of the first evaporator 150 and inlet and outlet temperatures of the second evaporator 160, in step S54. It may be recognized whether information about the inlet and outlet temperatures of the first and second evaporators 150 and 160 is included in a set or predetermined range. The recognition may use the determination in step S34, as illustrated in FIG. 4.

When the information about the inlet and outlet temperatures of the first and second evaporators 150 and 160 is within the set or predetermined range, it is recognized that the refrigerant is equally introduced into the first or second evaporator 150 or 160, and step S53 may be performed again. In contrast, when the information about the inlet and outlet temperatures of the first and second evaporators 150 and 160 is out of the set or predetermined range, it is recognized that the refrigerant is unequally introduced into the first or second evaporator 150 or 160, and a control state of the flow adjuster 130 may be changed. That is, when it is recognized that the refrigerant is unequally introduced into the first evaporator 150, the control state of the flow adjuster 130 may be changed into the second control state according to case 2, and when it is recognized that the refrigerant is unequally introduced into the second evaporator 160, the control state of the flow adjuster 130 may be changed into the first cantrol state according to case 1, in step S56.

Operation time information according to the control state of the flow adjuster 130, that is, control time information of the simultaneous cooling operation may be stored or updated. Thus, while the simultaneous cooling operation is performed according to repeated driving of the refrigerating cycle, an operation time may be stored according to the control state of the flow adjuster 130.

In particular, the operation time according to the control state of the flow adjuster 130 may include time information, based on which a first adjustment state of the flow adjuster 130, that is, a control state according to case 1 may be maintained, and time information, based on which a second adjustment state of the flow adjuster 130, that is, a control state according to case 2 may be maintained. While the simultaneous cooling operation is performed, it may be recognized whether the temperature sensor 210, 220, 230, or 240 of the first and second evaporators 150 and 160 has malfunctioned, or has a failure or problem. The recognition may use the recognition in step S33 as illustrated in FIG. 4.

When the temperature sensor 210, 220, 230, or 240 has not malfunctioned or does not have a failure or problem, steps S53 to S57 may be performed to continually store or update the operation time information of the flow adjuster 130. In contrast, when the temperature sensor 210, 220, 230, or 240 has malfunctioned or has a failure or problem, the simultaneous cooling operation may be performed according to the operation time information of the flow adjuster 130, which has been stored or updated during the simultaneous cooling operation before the malfunction, failure, or problem. As such, as the operation time information of the flow adjuster 130 may be stored or updated, even when a temperature sensor disposed on an evaporator has malfunctioned or has a failure or problem, the simultaneous cooling operation may be performed using previous time information, without performing the method from the start, thus stably and continually operating the refrigerator.

According to embodiments, a plurality of evaporators may be simultaneously operated, and thus, a plurality of storages may be effectively cooled. In particular, a plurality of refrigerant passages may be provided at an inlet side of at least one of the evaporators, and the refrigerant passages may be provided with expansion devices, respectively, to control flows of refrigerant.

In addition, while a refrigerator is operated, amounts of the refrigerant supplied to the evaporators may be adjusted based on a pre-stored time value and differences between inlet and outlet temperatures of the evaporators, thus effectively distributing refrigerant to the evaporators. As a result, a first control process in which an amount of the refrigerant supplied to one of the evaporators is increased, and a second control process in which amounts of the refrigerant supplied to the other evaporators are increased, may be basically performed according to time periods set during a simultaneous cooling operation (a time control of a flow adjuster).

In addition, as a control time value of the first and second control processes may be changed based on inlet and outlet temperature information of first and second evaporators, an accurate control may be performed to prevent the refrigerant from being unequally introduced into a specific one of the evaporators (a temperature control of the flow adjuster). In addition, information about a control time of the simultaneous cooling operation performed through time or temperature control of the flow adjuster may be stored or updated and may be used as information to drive the refrigerator.

In particular, even when an inlet or outlet temperature sensor of an evaporator malfunctions or has a failure or a trouble, simultaneous cooling operation may be continuously performed based on the stored or updated information, and thus, may be continually and stably performed.

In addition, flow rate adjusters may be provided on the refrigerant passages to adjust degrees of opening thereof, thereby accurately controlling flow rates of the refrigerant. In addition, when a plurality of compressors, that is, a high pressure compressor and a low pressure compressor are provided in the refrigerator, an inlet side refrigerant flow resistance of a high pressure evaporator may be smaller than that of a low pressure evaporator, thus preventing an unequal introduction of the refrigerant to the low pressure evaporator caused by a pressure difference of the refrigerant.

Embodiments disclosed herein provide a refrigerator and a method for controlling a refrigerator, which efficiently cool a plurality of storages.

Embodiments disclosed herein provide a method for controlling a refrigerator that may include driving a refrigerating cycle including a first evaporator and a second evaporator by activating a compressor; simultaneously supplying refrigerant to the first and second evaporators by controlling a flow adjusting part or flow adjuster; recognizing whether the refrigerant is unequally introduced into the first or second evaporator, by sensing a temperature of the first or second evaporator through or by a temperature sensor; reducing supply of the refrigerant to the evaporator into which the refrigerant is unequally introduced, by adjusting the flow adjusting part; storing information about an operation time of the flow adjusting part; recognizing whether the temperature sensor has malfunctioned or has a trouble or a failure or problem; and determining an operation time of the flow adjusting part according to whether the temperature sensor has malfunctioned or has a trouble or a failure or problem. When it is recognized that the temperature sensor has malfunctioned or has a trouble or a failure or problem, an operation time of the flow adjusting part may be determined based on the stored information about the operation time of the flow adjusting part.

Whether the temperature sensor has malfunctioned or has a trouble or a failure or problem may be determined according to whether a temperature value sensed at the temperature sensor is outside of an allowable range. When it is recognized that the temperature sensor has not malfunctioned or does not have a trouble or a failure or problem, the flow adjusting part may be controlled such that flow rates of the refrigerant supplied to the first and second evaporators are changed according to set or predetermined times.

The set times may include a first set or predetermined time and a second set or predetermined time, and the flow adjusting part may be controlled such that the flow rate of the refrigerant supplied to the first evaporator is increased for the first set time, and then, the flow rate of the refrigerant supplied to the second evaporator is increased for the second set time. The first set time and the second set time may be mapped onto values which are different according to both an outer temperature condition of the refrigerant and state information of a refrigerator compartment and a freezer compartment.

The state information of the refrigerator compartment and the freezer compartment may include at least one of information about a cooling activation state in which activation of the compressor starts; information about a load reaction state in which a temperature of the refrigerator compartment or the freezer compartment increases to be equal to or higher than a set or predetermined temperature; or information about a state in which the refrigerator compartment and the freezer compartment are simultaneously cooled.

Whether the set times are changed may be determined based on information about a difference between an inlet temperature and an outlet temperature of the first evaporator or a difference between an inlet temperature and an outlet temperature of the second evaporator, and the flow adjusting part may be controlled such that flow rates of the refrigerant supplied to the first evaporator and the second evaporator are changed according to the changed set times.

The information about the operation time of the flow adjusting part may include operation time information of the flow adjusting part operated according to the set times; and single operation time information of the first evaporator or the second evaporator, or time information, based on whether an operation of the compressor is turned off. When it is recognized that the temperature sensor has not malfunctioned or does not have a trouble or a failure or problem, the flow adjusting part may be controlled to switch to a first adjustment state in which the supply of the refrigerant to the first evaporator is increased or a second adjustment state in which the supply of the refrigerant to the second evaporator is increased, according to inlet and outlet temperatures of the first evaporator or the second evaporator. The information about the operation time of the flow adjusting part may include time information, based on which the first adjustment state of the flow adjusting part is maintained; and time information, based on which the second adjustment state of the flow adjusting part is maintained.

Embodiments disclosed herein further provide a refrigerator that may include a compressor that compresses refrigerant to drive a refrigerating cycle to supply cold air to a refrigerator compartment and a freezer compartment; a condenser that condenses the refrigerant compressed at the compressor; a refrigerant pipe arrangement that guides a flow of the refrigerant condensed at the condenser; a plurality of refrigerant passages that diverge from the refrigerant pipe arrangement and are provided with expansion devices; first and second evaporators to evaporate the refrigerant passed through the refrigerant passages; a temperature sensor that senses a temperature of the first or second evaporator; a flow adjusting part or flow adjuster that adjusts amounts of the refrigerant flowing through the refrigerant passages; a memory part or memory in which time information, based on which the flow adjusting part may be operated, may be stored or updated; and a control part or controller that controls the flow adjusting part such that the refrigerant is simultaneously supplied to the first evaporator and the second evaporator. When the control part recognizes that the temperature sensor has malfunctioned or has a failure or a trouble or problem, the control part may determine an operation time of the flow adjusting part, based on the time information stored in the memory part. Mapping information may be further stored in the memory part such that a first or second adjustment state of the flow adjusting part may be maintained for a set or predetermined time.

The first adjustment state of the flow adjusting part may be a state in which the flow adjusting part is controlled to increase an amount of the refrigerant supplied to the first evaporator. The second adjustment state of the flow adjusting part may be a state in which the flow adjusting part is controlled to increase an amount of the refrigerant supplied to the second evaporator. The memory part may further store information in which whether the set time is changed is mapped onto whether the refrigerant is unequally introduced into the first or second evaporator.

The refrigerant passages may include a first refrigerant passage provided with a first expansion device and connected to the first evaporator; a second refrigerant passage provided with a second expansion device and connected to the second evaporator; and a third refrigerant passage provided with a third expansion device and connected to the first evaporator. The refrigerant passages may further include a fourth refrigerant passage provided with a fourth expansion device and connected to the second evaporator.

The refrigerant passages may include a first refrigerant passage provided with a first expansion device and connected to the first evaporator; and a second refrigerant passage provided with a second expansion device and connected to the second evaporator. The refrigerator may further include a first flow rate adjusting part or flow rate adjuster provided on the first refrigerant passage to adjust a refrigerant amount; and a second flow rate adjusting part or flow rate adjuster provided on the second refrigerant passage to adjust a refrigerant amount.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a refrigerator, the method comprising:

driving a refrigterating cycle including a first evaporator and a second evaporator by activating a compressor;

supplying refrigerant to the first and second, evaporators by controlling a flow adjuster;

recognizing whether the refrigerant is unequally introduced into one of the first or second evaporator, by sensing a temperature of the refrigerant of the first or second evaporator using at least one temperature sensor;

reducing supply of the refrigerant to the one of fhe first or second evaporators into which the refrigerant is unequally introduced, by adjusting the flow adjuster;

storing information about an operation time of the flow adjuster;

recognizing whether the at least one temperature sensor has malfunctioned according to whether a temperature value sensed by the at least one temperature sensor is outside of an allowable range; and determining an operation time of the flow adjuster according to whether the at least one temperature sensor has malfunctioned, wherein the refrigerator further includes;

first, second, and third refrigerant passages, wherein the first and third refrigerant passages are configured to guide introduction of the refrigerant into the first evaporator and the second refrigerant passage is configured to guide introduction of the refrigerant into the second evaporator; and first, second, and third expansion devices installed in the first, second, and third refrigerant passages, respectively, wherein when it is recognized that the at least one temperature sensor has not malfunctioned,the flow adjuster is controlled such that;

the first, second, and third refrigerant passages are opened for a first predetermined period of time to allow a flow rate of the refrigerant supplied into the first evaporator to increase, and then, the first, the second refrigerant passages are opened and the third refrigerant passage is closed for a second predetermined period of time to allow a flow rate of the refrigerant, supplied into the first evaporator to increase.

2. The method according to claim 1, wherein when it is recognized that the at least one temperature sensor has malfunctioned, an operation time of the flow adjuster is determined based on the stored information about the operation time of the flow adjuster.

3. The method according to claim 1, wherein the first predetermined period of time and the second predetermined period of time are mapped onto vaules which are different according to both an outer temperature condition of the refrigerator and state Information of a refrigerator compartment and a freezer compartment.

4. The method according to claim 3, wherein, the state information of the refrigerator compartment and the freezer compartment comprises at least one of information about a cooling activation state in which activation of the compressor starts; information about a load reaction state temperature of the refrigerator compartment or the freezer compartment increases to to be equal to or higher than a predetermined temperature; or information about a state in which the refrigerator compartment and the freezer compartment are simultaneously cooled.

5. The method according claim 1, wherein whether the first or the second predeterrnined period of time is changed is determined based on information about a difference between an inlet temperature and an outlet temperature of the first evaporator or a difference between an inlet temperature and an outlet temperature of the second evaporator, and wherein the flow adjuster is controlled such that flow rates of the refrigerant supplied to the first evaporator and the second evaporator are changed according to the changed first or second predetermined period of time.

6. The method according to claim 1, wherein the information about the operation time of the flow adjuster comprises operation time information of the flow adjuster operated according to the first or the second predetermined period of time, and single operation time information of the first evaporator or the second evaporator, or time information, based on which an operation of the compressor is turned off.

7. The method according to claim 1, wherein when it is recognized that the at least one temperature sensor has not malfunctioned, the flow adjuster is controlled to switch to a first adjustment state in which supply of the refrigerant to the first evaporator is increased, or a second adjustment state in which supply of the refrigerant to the second evaporator is increased, according to inlet and outlet, temperatures of the first evaporator or the second evaporator.

8. The method according to claim 7, wherein the information about the operation time of the flow adjuster comprises time information, based on which the first adjustment state of the flow adjuster is maintained, and time information, based on which the second adjustment state of the flow adjuster is maintained.

9. The method according to claim 5, wherein when it is recognized that the refrigerant is concentrated into the first evaporator, the flow adjuster is controlled such that flow rate of the refrigerant supplied to the second evaporator is increased by fixing the first predetermined period time and increasing the second predetermined period of time.

10. The method according to claim 5, wherein when it is recognized that the refrigerant is concentrated into the second evaporator, the flow adjuster is controlled such that flow rate of the refrigerant supplied to the second evaporator is increased by fixing the first predetermined period time and decreasing the second predetermined period of time.

* * * * *